US011639067B2

(12) United States Patent
Lefevre et al.

(10) Patent No.: US 11,639,067 B2
(45) Date of Patent: May 2, 2023

(54) ACTIVE AIRFLOW CONTROL DEVICE FOR VACUUM PAPER TRANSPORT

(71) Applicant: Xerox Corporation, Norwalk, CT (US)

(72) Inventors: Jason M. Lefevre, Penfield, NY (US); Seemit Praharaj, Webster, NY (US); Michael J. Levy, Webster, NY (US); Douglas K. Herrmann, Webster, NY (US); Paul McConville, Webster, NY (US); Chu-Heng Liu, Penfield, NY (US); Linn C. Hoover, Webster, NY (US); David A. VanKouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 674 days.

(21) Appl. No.: 16/679,220

(22) Filed: Nov. 10, 2019

(65) Prior Publication Data

US 2021/0138803 A1 May 13, 2021

(51) Int. Cl.
*B41J 11/00* (2006.01)
*B41J 2/155* (2006.01)
(Continued)

(52) U.S. Cl.
CPC ..... *B41J 11/0085* (2013.01); *B41J 11/003* (2013.01); *B41J 11/007* (2013.01);
(Continued)

(58) Field of Classification Search
CPC ..... B41J 2/155; B41J 11/0085; B41J 11/003; B41J 11/007; B41J 11/0095; B41J 13/08;
(Continued)

(56) References Cited

U.S. PATENT DOCUMENTS 6,398,208 B1 6/2002 Yang et al.
6,543,948 B2 * 4/2003 Beehler ..... B41J 11/06 271/276
9,064,813 B2 6/2015 Kanakasabapathy et al.
(Continued)

OTHER PUBLICATIONS

Xerox Brenva HD Production Inkjet Press, 2018, Xerox Corporation.

(Continued)

*Primary Examiner* — Geoffrey S Mruk
(74) *Attorney, Agent, or Firm* — Ortiz & Lopez, PLLC; Luis M. Ortiz; Kermit D. Lopez

(57) ABSTRACT

A marker transport system and a method of operating the marker transport system. A group of print bars is located with respect to a marker transport platen and a marker transport belt. A vacuum source and a pneumatic solenoid block are associated with the marker transport platen. The marker transport platen includes airflow sections divided into process-direction slots and cross-section direction slots. The cross-section direction slots are located beneath the print bars and are connected to the vacuum source via the pneumatic solenoid block, which facilitates an individual control of each of the cross-process direction slots. Pneumatic valves are associated with the pneumatic solenoid block, which supplies a flow of vacuum to the cross-process direction vacuum slots. The pneumatic vales can be timed to allow the vacuum to be present when a sheet is present over a corresponding vacuum slot among the process-direction slots and the cross-section direction slots.

9 Claims, 11 Drawing Sheets

(51) Int. Cl.
*B65H 5/22* (2006.01)
*B41J 13/08* (2006.01)

(52) U.S. Cl.
CPC ..... *B65H 5/224* (2013.01); *B41J 2/155* (2013.01); *B41J 13/08* (2013.01); *B65H 2406/3222* (2013.01)

(58) Field of Classification Search
CPC ..... B65H 5/224; B65H 2406/3222; B65H 2406/3221; B65H 2406/3622; B65H 2406/3632; B65H 2406/41; B65H 2801/03; B65H 7/02
See application file for complete search history.

(56) References Cited

U.S. PATENT DOCUMENTS

| | | | |
|---|---|---|---|
| 9,492,891 | B2 | 11/2016 | Herrmann |
| 9,796,546 | B1 | 10/2017 | LeFevre et al. |
| 9,944,094 | B1 | 4/2018 | Herrmann et al. |
| 10,102,456 | B2 | 10/2018 | Herrmann |
| 10,358,307 | B1 | 7/2019 | Liu et al. |
| 10,427,421 | B1 | 10/2019 | LeFevre et al. |
| 2018/0081302 | A1 | 3/2018 | Wu et al. |
| 2018/0136888 | A1 | 5/2018 | Robinson et al. |

OTHER PUBLICATIONS

SheetFeeder BV, Jet speed productivity, 2018, Tecnau.
Xerox Brenva HD, Production Injet Press Overview, 2016, Xerox Corporation.

* cited by examiner

Airflow in cross-process zone indicated by Red (vacuum OFF), or *Green (vacuum ON)*: (e.x. *A*, *B*, *C*, *D*...)

Airflow in cross-process zone indicated by Red (vacuum OFF), or Green (vacuum ON); (e.x. A, B, C, D...)

ACTIVE AIRFLOW CONTROL DEVICE FOR VACUUM PAPER TRANSPORT

TECHNICAL FIELD

Embodiments are related to printing systems. Embodiments also relate to transports, transport belts, radiant dryers and other components utilized in printing systems. Embodiments further relate to a vacuum paper transport and an active airflow control device for a printing system.

BACKGROUND

Printing systems known in the document reproduction arts can apply a marking material, such as ink or toner, onto a substrate such as a sheet of media of such as paper, a textile, metal, plastic and objects having a non-negligible depth such as a coffee cup, bottle, and the like.

A printing system (which can also referred to simply as a printer) can perform printing of an image or the like on sheets of paper, for example, by transporting a sheet of paper (or other media substrates), which is an example of a medium, up to a position of a printing section using a transport roller, and an endless form transport belt, which can rotate while coming into contact with the sheet of paper, and discharging ink, which is an example of a liquid, toward the sheet of paper from a liquid discharging head.

Some printing systems are based on the use of a vacuum belt configuration. In such vacuum belt printing systems, which use a vacuum belt transport to transport media (e.g., sheets of paper), the area in which no sheet is present at an inter-document zone (IDZ) may create unwanted airflow by the print heads to a vacuum belt gap between the media. This airflow can create turbulence around the jets and ink droplets may be deflected from their intended trajectory. This situation can lead to degradation in printing accuracy and a resulting distorted image.

A current problem with vacuum belt printing systems is that the technology used to create the vacuum under the media can also creates a vacuum at the IDZ. With no media to block the airflow caused by the vacuum, the air may be pulled across the face of the ink jet head and the air velocity can cause dispersion of the jetted ink drops between the head and the sheet. This error can be in evidenced at both the LE (Leading Edge) and TE (Trailing Edge) of the sheets.

FIG. 1 demonstrates this problem as shown in a schematic diagram of a prior art print head apparatus 100 having a vacuum that draws through gaps to the IDZ, which can cause a disturbance at the TE of the sheet. The print head apparatus 100 shown in FIG. 1 can include a frame 114 and a base plate 118. A print head 116 can be supported by and extend through the frame 114. The frame 114 can be located above an envelope 102 and an envelope 103. A gap 110 can be located and configured between the envelope 102 and the envelope 103. The vacuum can draw air through the gap 110 as indicated by arrow 112, which may cause a disturbance at the TE of the sheet (e.g., a sheet of paper). In FIG. 1, arrow 104, arrow 108 and arrow 112 indicate the flow of air between the frame 114 and the base plate 118, and below the base plate 118. The area 106 indicates the air volume.

FIG. 2 illustrates a prior art image 120 of a defect with an IDZ vacuum ON and the IDZ vacuum OFF. The image 120 shown in FIG. 2 demonstrates the types of defects that may occur due to the problems described above.

Ideally the vacuum should be present only under the media and not at the IDZ. The sheet, however, may need to have a vacuum up to the edges of the sheet so a change in a permanent underlying plenum can create a no-vacuum area under the print head and lead to the media separating from the belt and creating an uneven print surface as well as the undesired possibility of the media contacting the printhead.

Airflow disturbances at the IDZ from the vacuum system can thus cause LE and TE disturbances that affect ink drop placement and degrade print quality in direct-to-paper inkjet systems. Some printing systems may use a vacuum transport to hold down and transport the media. The vacuum at the LE and TE gaps of the sheets draw air from under the print heads and can disturb the ink drop position such that the drop placement accuracy is degraded. This degradation in drop placement accuracy can result in a noticeable and objectionable "blurring" of the image.

One of the enabling characteristics of aqueous inks made for printing on coated media is that they dry very quickly. This can leads to high evaporation rates, which can also lead to latency and missing jets. The vacuum drawn from under the print heads during cycle up and cycle down while the printing system is being made ready, causing higher latency and missing jets, may enhance this evaporation.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved printing system.

It is another aspect of the disclosed embodiments to provide for a marker transport system for use with a printing system.

It is a further aspect of the disclosed embodiment to provide for a method of operating the marker transport system.

It is also an aspect of the disclosed embodiments to provide for active airflow control for a marker transport system that includes a vacuum paper transport.

The aforementioned aspects and other objectives and advantages can now be achieved as described herein. In an embodiment, a marker transport system can include a plurality of print bars located with respect to a marker transport platen and a marker transport belt; a vacuum source and a pneumatic solenoid block associated with the marker transport platen, wherein the vacuum source generates a vacuum and wherein the marker transport platen is configured with airflow sections divided into process-direction slots and cross-section direction slots, wherein the cross-section direction slots are located beneath the plurality of print bars and are connected to the vacuum source via the pneumatic solenoid block, wherein the pneumatic solenoid block facilitates an individual control of each of the cross-process direction slots; and a plurality of pneumatic valves associated with the pneumatic solenoid block, which supplies a flow of the vacuum to the cross-process direction vacuum slots, wherein the plurality of pneumatic vales is timed to allow the vacuum to be present when a sheet of media is present over a corresponding vacuum slot among the process-direction slots and the cross-section direction slots.

An embodiment of the marker transport system can include at least one sensor for determining a leading edge and a trailing edge of a sheet relative to a position on the marker transport belt.

In an embodiment of the marker transport system, the at least one sensor can comprise a belt-hole sensor, a page-sync sensor, or a combination of a belt-hole sensor and a page-sync sensor.

In an embodiment of the marker transport system, the process-direction slots can be associated with a plurality of process-section channels configured from the marker transport platen and the cross-process direction vacuum slots can be associated with a plurality of process-section channels configured from the marker-transport platen.

In an embodiment, a printing system can include the marker transport system.

In an embodiment, a method of operating a marker transport system, can involve: generating a vacuum with a vacuum source, wherein the vacuum source and a pneumatic solenoid block are associated with a marking transport platen, wherein a plurality of print bars is located with respect to the marker transport platen and a marker transport belt, wherein the marker transport platen is configured with airflow sections divided into process-direction slots and cross-section direction slots, wherein the cross-section direction slots are located beneath the plurality of print bars and are connected to the vacuum source via the pneumatic solenoid block, wherein the pneumatic solenoid block facilitates an individual control of each of the cross-process direction slots; and timing a plurality of pneumatic valves associated with the pneumatic solenoid block, which supplies a flow of the vacuum to the cross-process direction vacuum slots, to allow the vacuum to be present when a sheet of media is present over a corresponding vacuum slot among the process-direction slots and the cross-section direction slots.

An embodiment of the method can further involve determining with at least one sensor, a leading edge and a trailing edge of a sheet relative to a position on the marker transport belt.

In an embodiment of the method, the at least one sensor can comprise a belt-hole sensor, a page-sync sensor, or a combination of a belt-hole sensor and a page-sync sensor.

In an embodiment of the method, the process-direction slots can be associated with a plurality of process-section channels configured from the marker transport platen and wherein the cross-process direction vacuum slots can be associated with a plurality of process-section channels configured from the marker-transport platen.

In an embodiment of the method, a printing system can include the marker transport system.

In another embodiment, a system can include at least one processor; and a non-transitory computer-usable medium embodying computer program code, said computer-usable medium capable of communicating with said at least one processor, said computer program code comprising instructions executable by said at least one processor and configured for: generating a vacuum with a vacuum source, wherein the vacuum source and a pneumatic solenoid block are associated with a marking transport platen, wherein a plurality of print bars is located with respect to the marker transport platen and a marker transport belt, wherein the marker transport platen is configured with airflow sections divided into process-direction slots and cross-section direction slots, wherein the cross-section direction slots are located beneath the plurality of print bars and are connected to the vacuum source via the pneumatic solenoid block, wherein the pneumatic solenoid block facilitates an individual control of each of the cross-process direction slots; and timing a plurality of pneumatic valves associated with the pneumatic solenoid block, which supplies a flow of the vacuum to the cross-process direction vacuum slots, to allow the vacuum to be present when a sheet of media is present over a corresponding vacuum slot among the process-direction slots and the cross-section direction slots.

In an embodiment of the system, the instructions can be further configured for determining with at least one sensor, a leading edge and a trailing edge of a sheet relative to a position on the marker transport belt.

In an embodiment of the system, the at least one sensor can comprise a belt-hole sensor, a page-sync sensor, or a combination of a belt-hole sensor and a page-sync sensor.

In an embodiment of the system, the process-direction slots can be associated with a plurality of process-section channels configured from the marker transport platen and wherein the cross-process direction vacuum slots can be associated with a plurality of process-section channels configured from the marker-transport platen.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
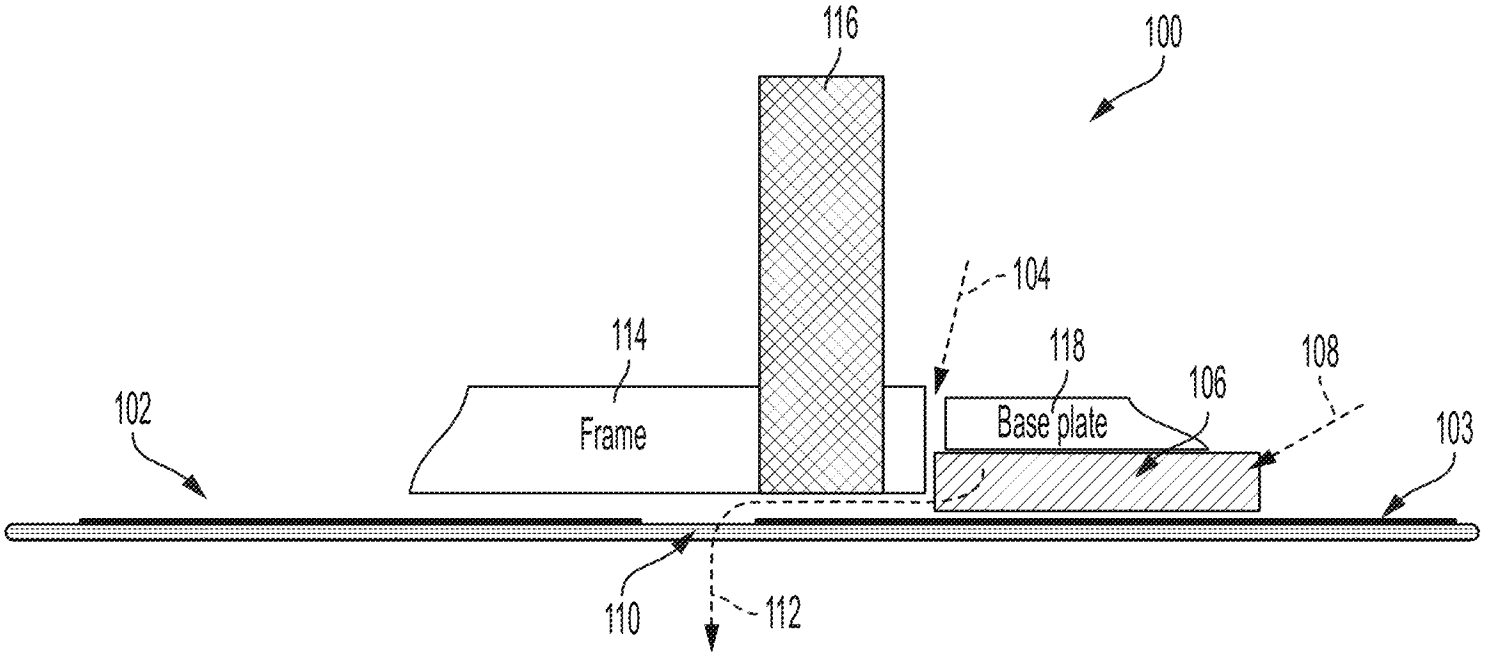
FIG. 1 (PRIOR ART)
FIG. 1 illustrates a schematic diagram of a prior art print head apparatus with vacuum drawing through gaps to the IDZ, causing a disturbance at the TE of the sheet.
Figure 2:
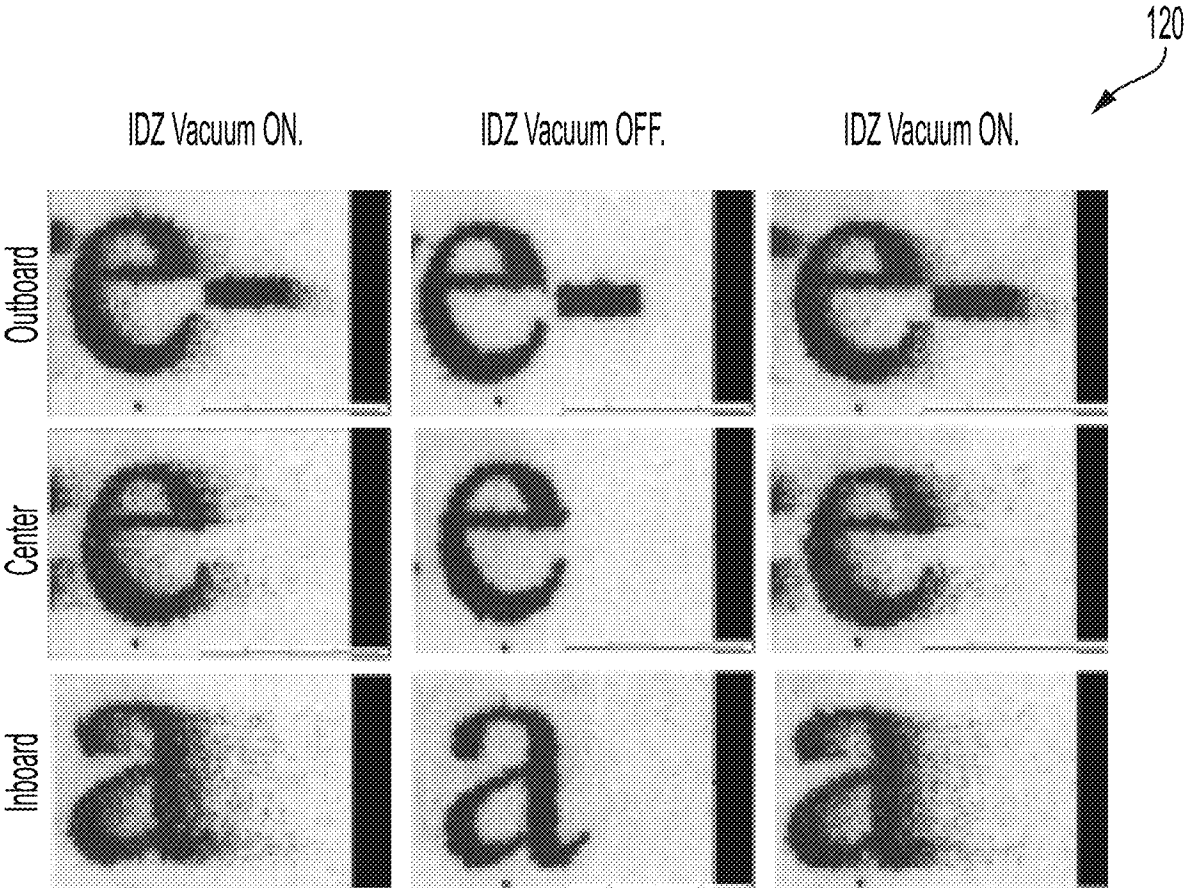
FIG. 2 (PRIOR ART)
FIG. 2 illustrates a prior art image of a defect with an IDZ vacuum ON and the IDZ vacuum OFF.

The particular values and configurations discussed in these non-limiting examples can be varied and are cited merely to illustrate one or more embodiments and are not intended to limit the scope thereof.

Subject matter will now be described more fully herein after with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems/devices. Accordingly, embodiments may, for example, take the form of hardware, software, firmware or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms, such as "and", "or", or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a", "an", or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Additionally, the term "step" can be utilized interchangeably with "instruction" or "operation".

Unless defined otherwise, all technical and scientific terms used herein have the same meanings as commonly understood by one of ordinary skill in the art. As used in this document, the term "comprising" means "including, but not limited to."

The term "printing system" as utilized herein can relate to a printer, including digital printing devices and systems that accept text and graphic output from a computing device, electronic device or data processing system and transfers the information to a substrate such as paper, usually to standard size sheets of paper. A printing system may vary in size, speed, sophistication, and cost. In general, more expensive printers are used for higher-resolution printing. A printing system can render images on print media, such as paper or other substrates, and can be a copier, laser printer, book-making machine, facsimile, or a multifunction machine (which can include one or more functions such as scanning, printing, archiving, emailing, faxing and so on). A non-limiting example of a printing system that can be adapted for use with one or more embodiments is the printing system 310 depicted in FIG. 9 and FIG. 12.

The term "transport belt" as utilized herein can relate to a belt implemented in a printing system in association with a rotatable member such as a roller or other transport members or web transport configurations. Such a transport belt can relate to a marker transport system or marker transport belt. To permit a high registration accuracy, a printing system can employ a market transport belt, which in some implementations can pass in front of toner cartridges and each of the toner layers can be precisely applied to the transport belt. The combined layers can be then applied to the paper in a uniform single step. It should be appreciated, however, that the disclosed embodiments are not limited to printers that utilize toner. Ink and other types of marking media may be utilized in other printing embodiments. That is, a printing system is not limited to a laser printing implementation but may be realized in other contexts, such as ink-jet printing systems. The term transport belt can encompass the term "marker transport belt".

A "computing device" or "electronic device" or "data processing system" refers to a device or system that includes a processor and non-transitory, computer-readable memory. The memory may contain programming instructions that, when executed by the processor, cause the computing device to perform one or more operations according to the programming instructions. As used in this description, a "computing device" or "electronic device" may be a single device, or any number of devices having one or more processors that communicate with each other and share data and/or instructions. Examples of computing devices or electronic devices include, without limitation, personal computers, servers, mainframes, gaming systems, televisions, and portable electronic devices such as smartphones, personal digital assistants, cameras, tablet computers, laptop computers, media players and the like. Various elements of an example of a computing device or processor are described below with reference to FIG. 10 and FIG. 11.

As will be discussed in greater detail herein, a marker transport system and components thereof are disclosed, which can provide a full vacuum under the media (e.g., a sheet of paper or sheets of paper) as the media traversed the entire print path in a printing system. The disclosed marker transport system can be configured with an active airflow control device for vacuum paper transport that allows for a no-vacuum IDZ that moves along with the sheets under the print heads. This can be accomplished with a passive airflow control device, as disclosed herein, which can include a marker transport platen with airflow sections that can be divided into the existing process-direction slots, as well as cross-process direction slots.

The cross-process directions slots (which can be located underneath the print-bar locations) can be connected to a vacuum source via a pneumatic solenoid block. The solenoid can allow for individual control to each of the cross-process direction slots. Solenoid valves (e.g., mini-valves) may be utilized with the disclosed embodiments. Using a belt-hole sensor, a page-sync sensor, a combination of a belt-hole sensor and page-sync sensor, and/or another type of sensor, the leading edge and the trailing edge of a sheet can be determined relative to a position on the marker transport belt. Using this information, the pneumatic valves, which can supply vacuum flow to the cross-process direction vacuum slots, can be timed such that vacuum is only present when the sheet is present over the corresponding vacuum slot. It should be appreciated that the use of a belt-hole sensor and/or a page-sync sensor should not be considered a limiting feature of the disclosed embodiments. Other types of sensors or combinations thereof may be utilized in place of a belt-hole sensor and/or a page-sync sensor.

With this approach, the cross-process direction airflow over the surface of the paper at the LE and the TE can be significantly reduced, and therefore image "Blur" may also be reduced. Existing marker transport vacuum belts can be adapted for use with the disclosed embodiments.

Figure 3:
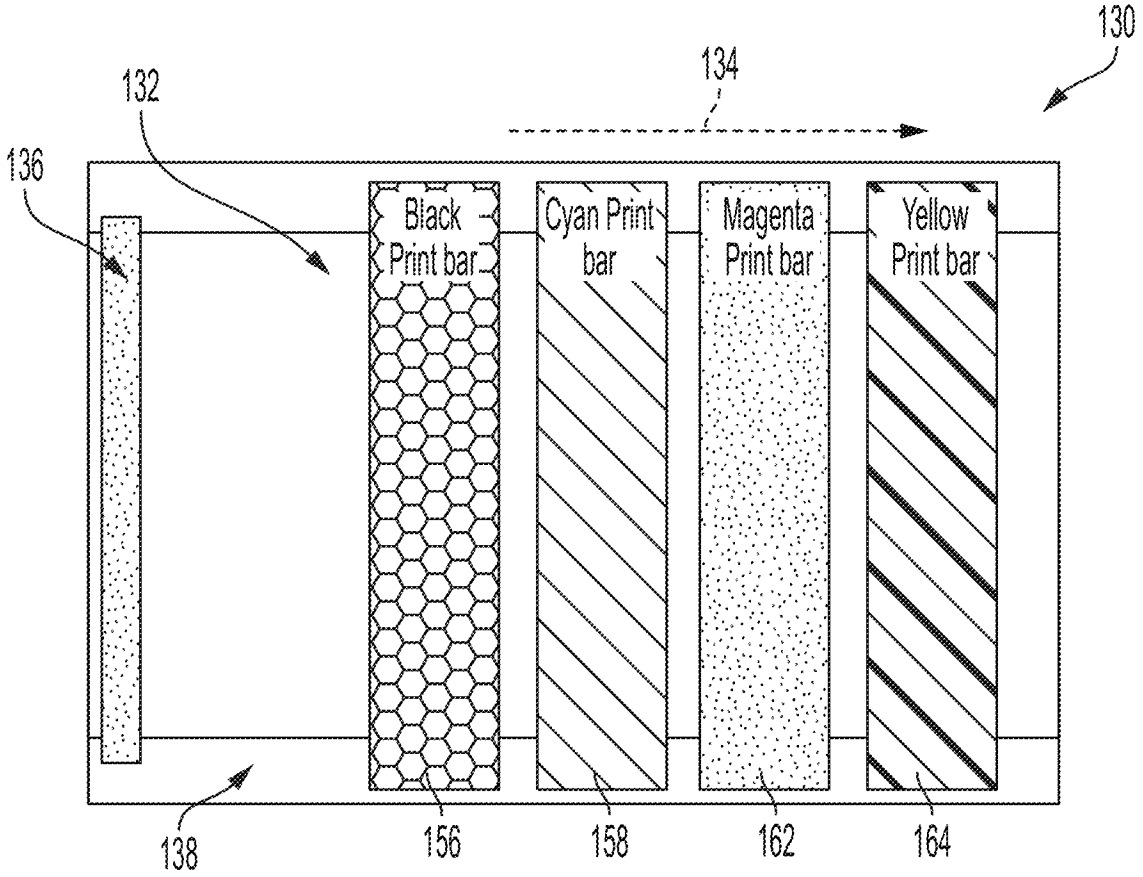
FIG. 3 illustrates a top view of a marker transport system that includes a group of print bars, in accordance with an embodiment.

FIG. 3 illustrates a top view of a marker transport system 130 with a group of print bars including a print bar 156, a print bar 158, a print bar 162, and a print bar 164, in accordance with an embodiment. The print bar 156 may be a black print bar, and the print bar 158 may be a cyan print bar. Likewise, the print bar 162 may be a magenta print bar, and the print bar 164 may be a yellow print bar. The print bar 156, the print bar 158, the print bar 162, and the print bar 164 can be implemented as part of an ink set capable of respectively printing black, cyan, magenta, and yellow.

Figure 9:
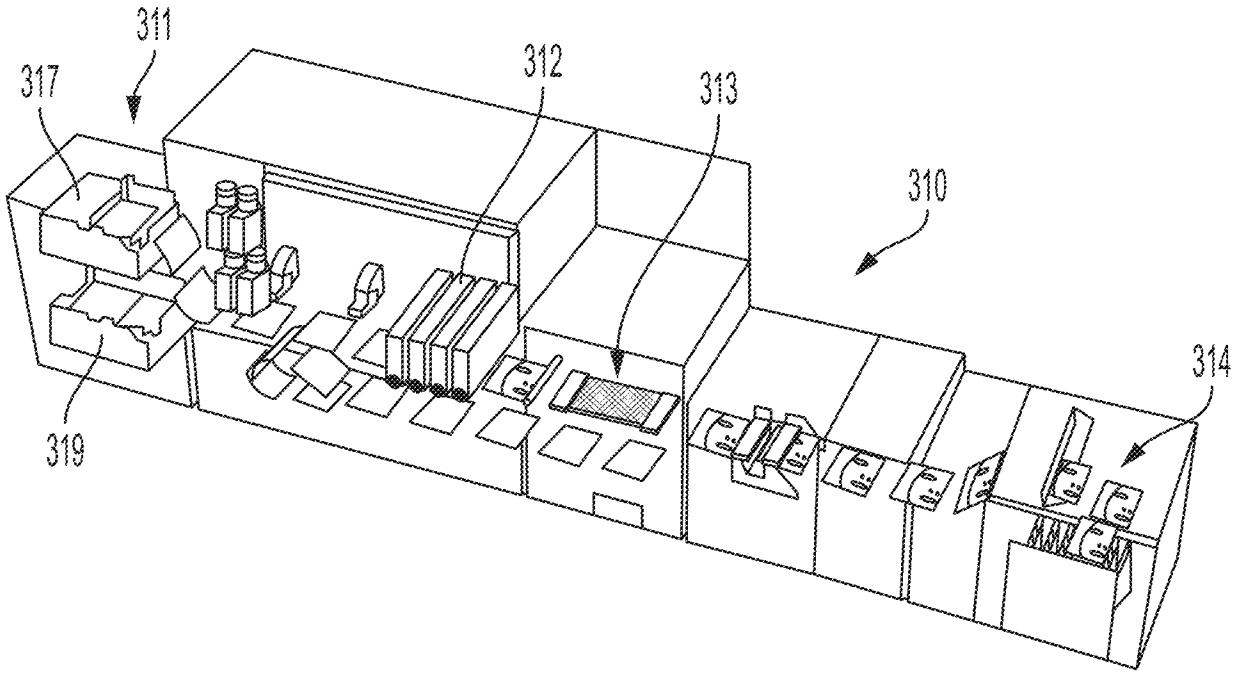
FIG. 9 illustrates a pictorial diagram depicting a printing system in which an embodiment may be implemented.
Figure 12:
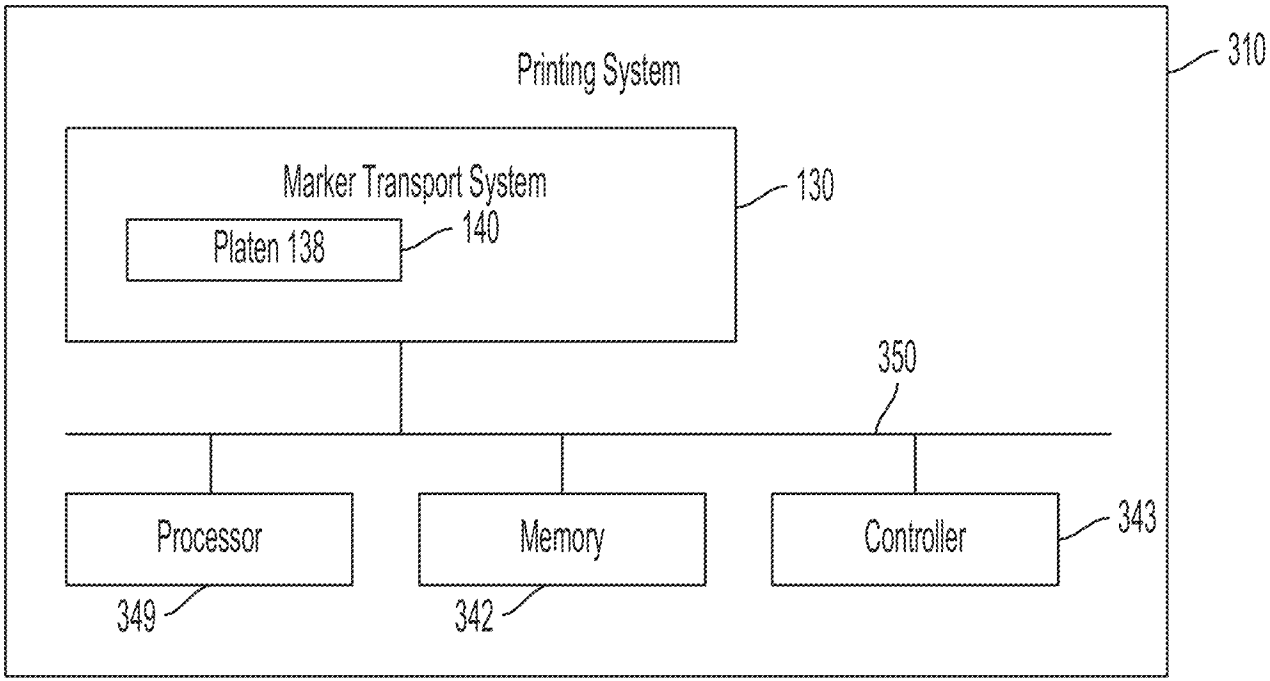
FIG. 12 illustrates a block diagram depicting a printing system, which can include a vacuum roller system that includes the operator side vacuum baffle roller system sub-assembly, in accordance with an embodiment.

The marker transport system 130 can be incorporated into a printing system such as, for example, the printing system 310 shown in FIG. 9 and FIG. 12. The marker transport system 130 can include a marker transport platen 138, a market transport belt 132, and an iron on roller 136. The marker transport system 130 moves from left to right in a process direction 134.

Figure 8:
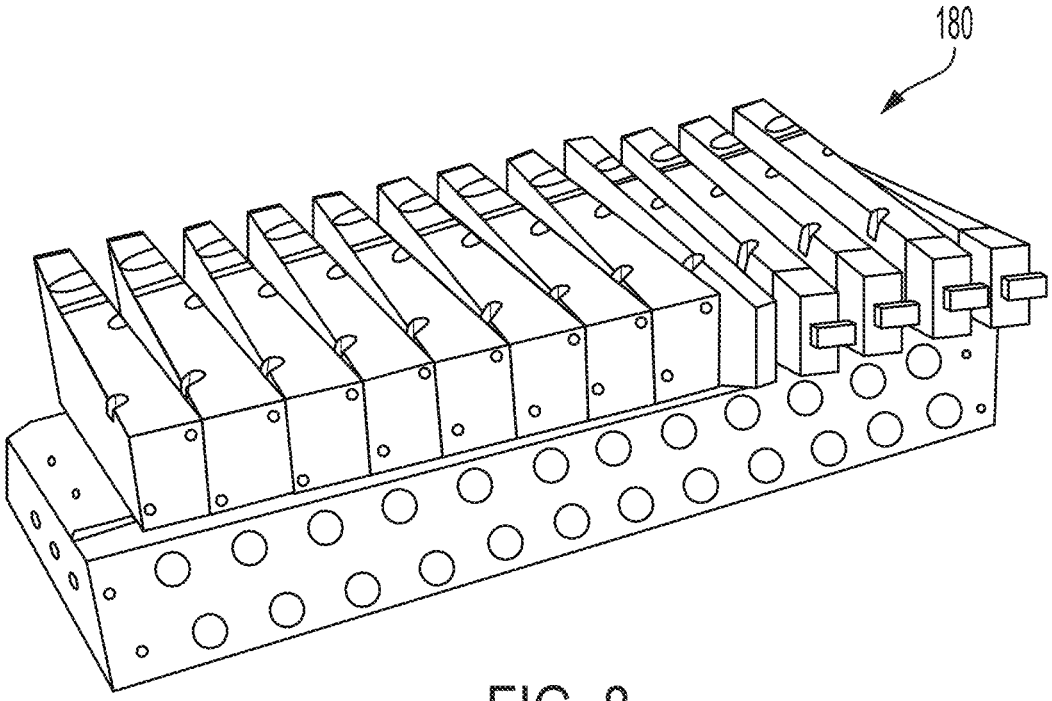
FIG. 8 illustrates a pictorial view of an exemplary pneumatic manifold, which can be used to supply vacuum for two print bars (and up to 6-zones per print-bar), in accordance with an embodiment.

The configuration shown in FIG. 3 can be implemented as a 4-color printing system. As shown in FIG. 3, the marker transport belt 132 occupies most of the marker transport platen 138. A pattern of small holes in the marker transport belt 132 can align with slots in the marker transport platen 138. In an embodiment, stock vacuum fans can be utilized to feed process and cross-process direction slots in the marker transport platen 138. Such cross-process slots, however, can be connected individually via a pneumatic solenoid block, an example of which is shown in FIG. 8.

Figure 4:
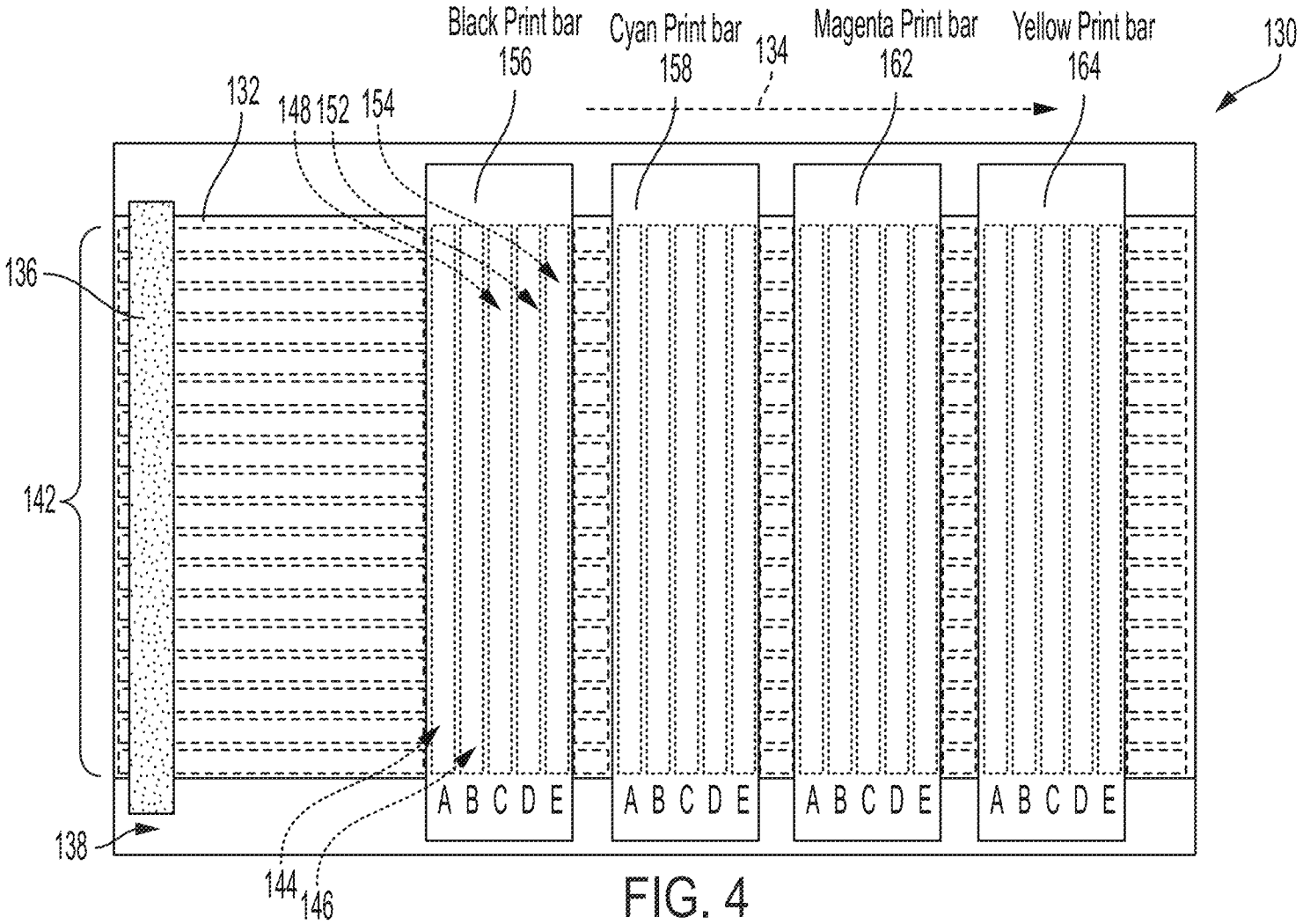
FIG. 4 illustrates a top view of the marker transport system shown in FIG. 3 including the marker transport platen vacuum channels, and the marker transport platen with the marker transport belt removed, in accordance with an embodiment.

FIG. 4 illustrates a top view of the marker transport system 130 shown in FIG. 3 including two groups of marker transport platen vacuum channels, in accordance with an embodiment. The first of the two groups of marker transport platen vacuum channels includes process air channels 142. The second of the two groups of marker transport platen vacuum channels includes cross-process air channels, examples of which are a cross-process air channel 144, a cross-process air channel 146, a cross-process air channel 148, a cross-process air channel 152, and a cross-process air channel 154, which is shown in FIG. 4 with respect to the print bar 156. It should be appreciated that similar cross-process air channels are associated with the other print bars 158, 162, and 164.

The top view of the marker transport system 130 shown in FIG. 4 depicts the marker transport platen 138 with the marker transport belt 132 removed. Note that in the figures illustrated and described herein, identical or similar parts are indicated by identical reference numerals. The marker transport system 130 can thus include a series of process direction air channels, which can align to the vacuum holes in the marker transport belt 132. Under the print bar locations in place of the process direction air channels, a series of cross-process direction air channels can be implemented. These air channels can be individually connected to a common vacuum supply for the marker transport.

Figure 5:
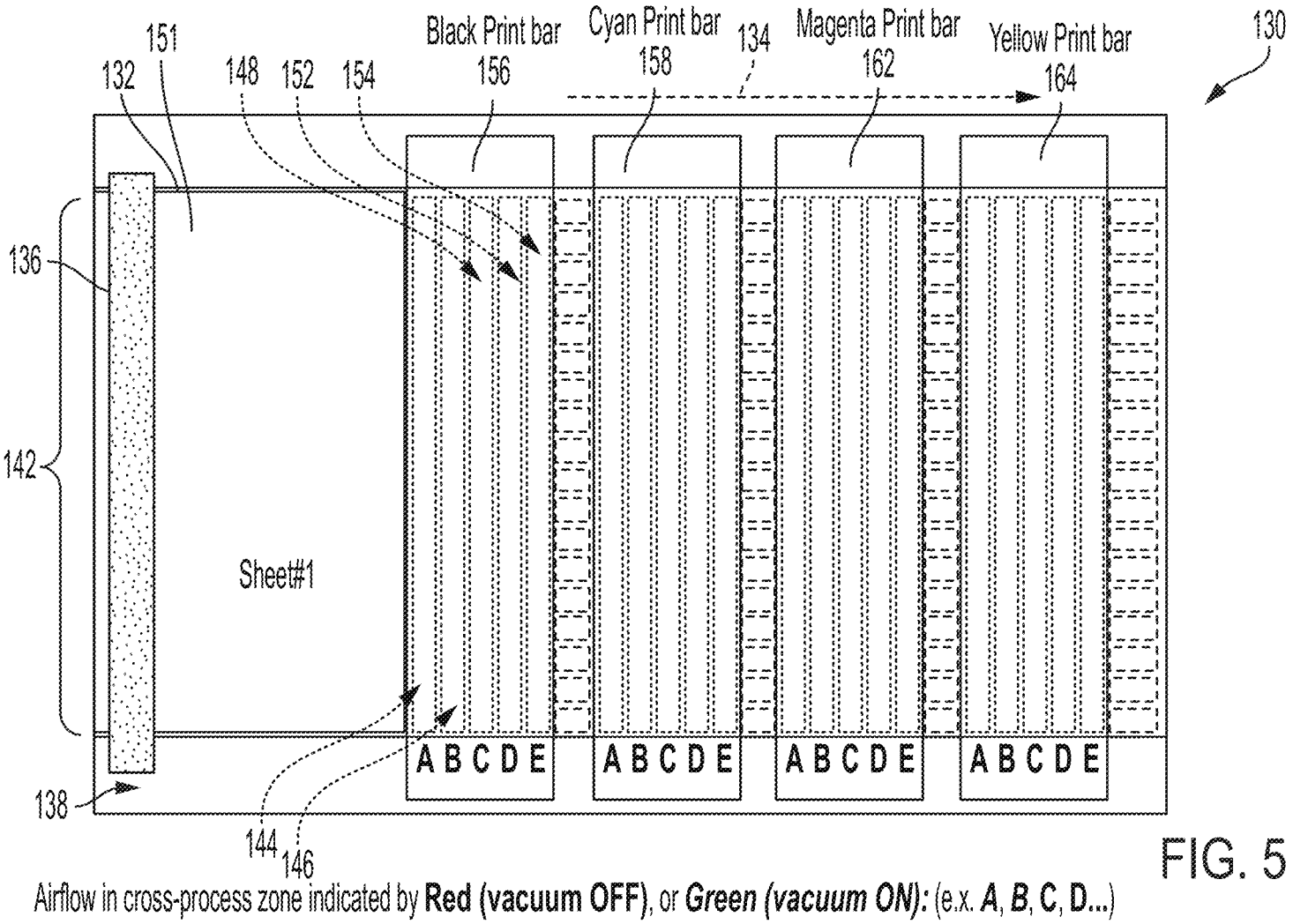
FIG. 5 illustrates a top view of the marker transport system shown in FIGS. 3-4 including marker transport platen vacuum channels as a first sheet of paper enters a marking zone, in accordance with an embodiment.

FIG. 5 illustrates a top view of the marker transport system 130 shown in FIGS. 3-4 including marker transport platen vacuum channels as a first sheet 151 of paper enters a marking zone, in accordance with an embodiment. Note that airflow in a cross-process zone can be indicted by the color Red (vacuum OFF) or Green (vacuum ON). For example, A and B may be Green and C and D may be Red, and so on. In FIG. 5, the marker transport system 130 is shown (for illustrative purposes) with the marker transport belt 132. The first sheet 151 can enter the marker transport system 130, with all the process direction air channels receiving constant vacuum, and all of the cross-process direction air channels in an OFF state.

Figure 6:
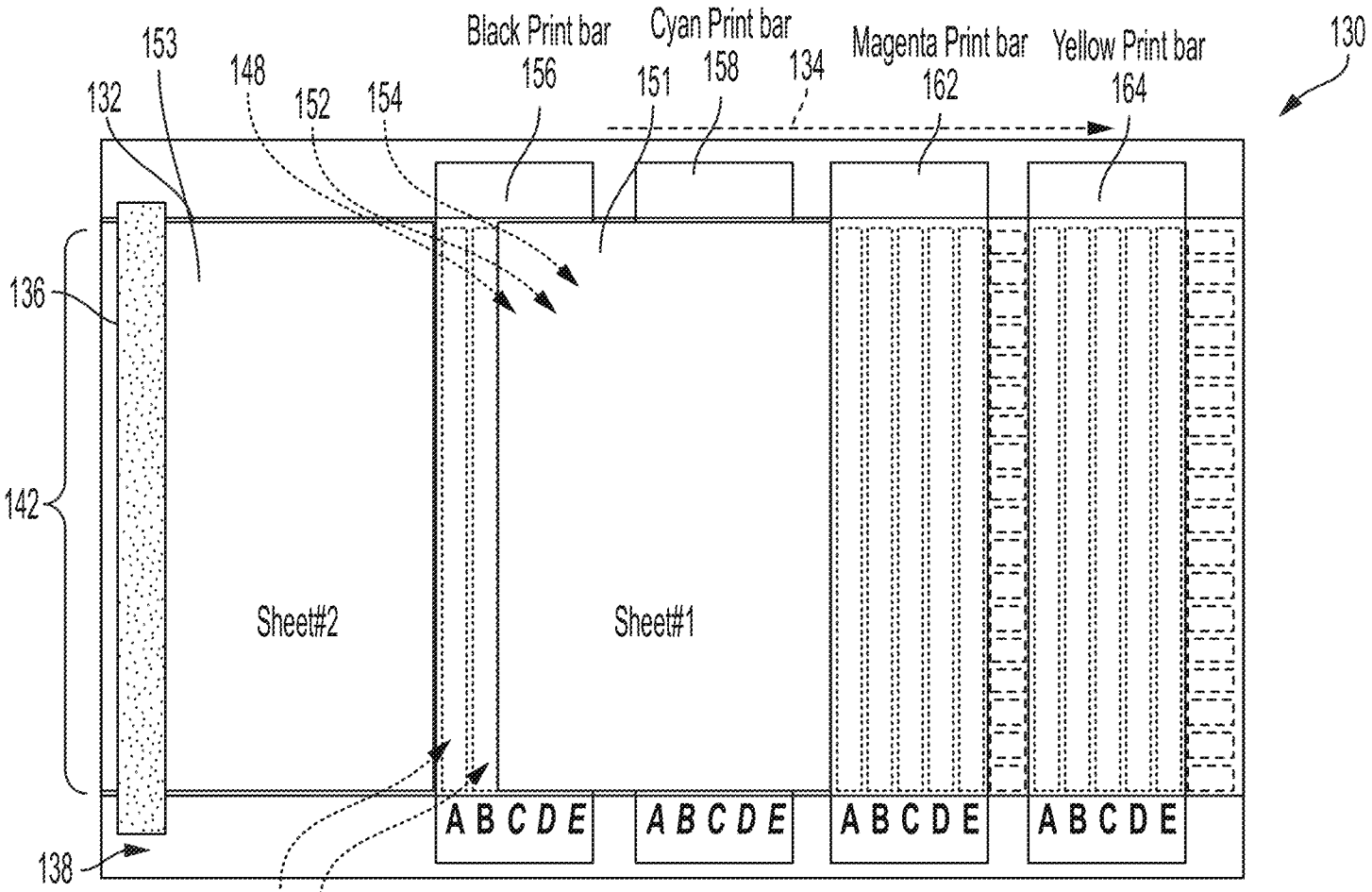
FIG. 6 illustrates a top view of the marker transport system shown in FIGS. 3-5 including the marker transport platen vacuum channels as a second sheet of paper enters the marking zone, in accordance with an embodiment.

FIG. 6 illustrates a top view of the marker transport system 130 shown in FIGS. 3-5 including the marker transport platen vacuum channels as a second sheet 153 of paper enters the marking zone, in accordance with an embodiment. As discussed previously the marker transport platen vacuum channels include the process air channels 142 and the cross-process air channels 144, 146 148, 152, and 154. The first sheet 151 is shown in FIG. 6 moving left to right, and the second sheet 153 is shown to the left of the first sheet 151. Thus, FIG. 6 illustrates the marker transport system 130 as the second sheet 153 enters the marking zone Using the information gathered from a marker transport belt hole sensor, page sync sensor, the cross-process zones can be actuated, so that the vacuum is present in those zones when the sheet is present in that area. When the sheet is not present in that area, the vacuum can be disabled via a pneumatic solenoid (e.g., such as shown in FIG. 8). In this manner, there is never a situation where the vacuum is allowed in the IDZ.

Figure 7:
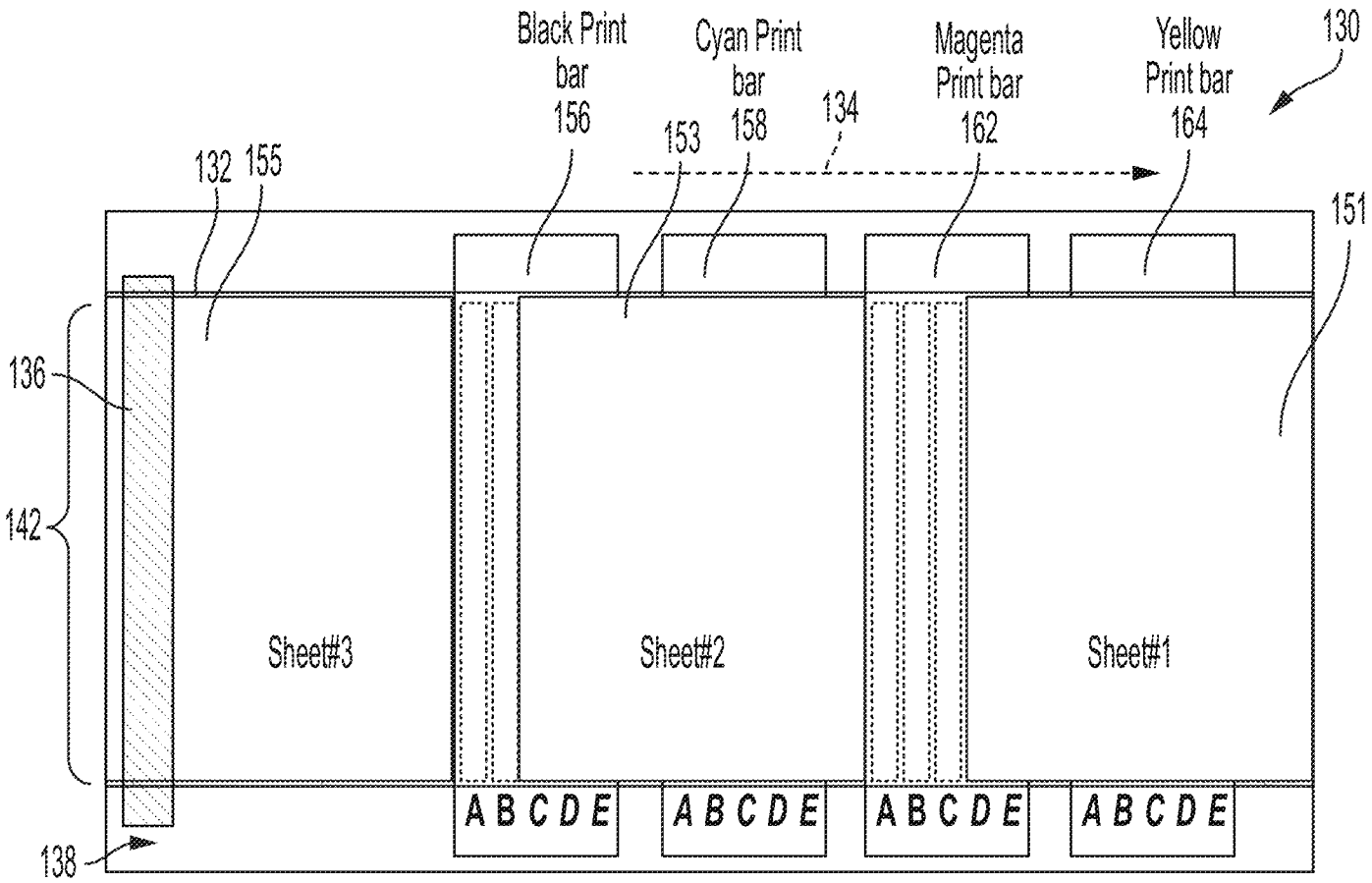
FIG. 7 illustrates a top view of the marker transport system shown in FIGS. 3-6 including the marker transport platen vacuum channels as a third sheet of paper enters the marking zone, in accordance with an embodiment.

FIG. 7 illustrates a top view of the marker transport system 130 shown in FIGS. 3-6 including the marker transport platen vacuum channels as a third sheet 155 of paper enters the marking zone, in accordance with an embodiment. The first sheet 151 is shown in FIG. 7 to the right of the second sheet 153 and the second sheet 153 is in turn shown to the right of the third sheet 155. Thus, FIG. 7 depicts additional sheets entering the marker transport and the response that a feed-forward control loop can provide for the timing of the previously mentioned pneumatic solenoids. Again, this is so that there is vacuum only in zones under the print head where paper is present.

FIG. 8 illustrates a pictorial view of an exemplary pneumatic manifold 180, which can be used to supply vacuum for two print bars (and up to 6-zones per print-bar), in accordance with an embodiment. It should be appreciated that the pneumatic manifold 180 depicted in FIG. 8 is just one example of a pneumatic device that can be adapted for use with the disclosed embodiments. Other type of manifold devices may be implemented in accordance with other embodiments.

Based on the foregoing it can be appreciated that the marker transport system 130 can be configured with a media tracking IDZ that moves with the sheet through the printing process (e.g., vacuum only applied in "zones" where the sheet is present). The marker transport system 130 can include the marker transport platen 138 with airflow sections that can be divided into the existing process-direction slots, as well as cross-process direction slots, as shown in FIG. 3-7.

Additionally, cross-process directions slots (i.e., located underneath all print-bar locations) can be connected to a vacuum source via a pneumatic solenoid block such as the pneumatic manifold 180 shown in FIG. 8. Pneumatic solenoid valves will allow for individual control to each of the cross-process direction slots. Pneumatic solenoid valves, which can supply vacuum flow to the cross-process direction vacuum slots, can be timed such that vacuum may be only present when a sheet is present over a corresponding vacuum slot.

The marker transport system 130 can reduce and/or eliminate cross-airflow at the LE and TE of a sheet in a printing system with a vacuum belt transport and can reduce the disturbance caused by moving air in the inter-copy gap by the print heads. The marker transport system 130 can also improve TE ink drop placement error on the Artisan print process. The marker transport system 130 can also provide a non-vacuum area inter-copy gap on a vacuum transport that moves along with the media, thereby reducing or eliminating airflow between the media sheets throughout the entire belt path. In addition, the marker transport system 130 can reduce the vacuum loss at the inter-copy gap for improved vacuum transport efficiency. Thus, less bulk vacuum may be needed to provide an equivalent sheet hold-down force. In addition, with the marker transport system 130 there is no need for marker transport belt to be re-designed, and the use of the existing belt if acceptable.

FIG. 9 illustrates a pictorial diagram depicting an example printing system 310 in which an embodiment may be implemented. In some embodiments, the printing system 310 can be implemented as an aqueous inkjet printer. The printing system 310 can include an internal vacuum plenum roller system, as disclosed herein. The printing system 310 can also include a number of sections or modules, such as, for example, a sheet feed module 311, a print head and ink assembly module 312, a dryer module 313 and a production stacker 314. The sheet feed module 311 can include a module 317 that maintains or stores sheets or media. The sheet feed module 311 can also include another module 319 that can also maintain or store sheets of media. Such modules can be composed of physical hardware components, but in some cases may include the use of software or may be subject to software instructions.

It should be appreciated that the printing system 310 depicted in FIG. 9 represents one example of an aqueous inkjet printer that can be adapted for use with one or more embodiments. The particular configuration and features shown in FIG. 9 should not be considered limiting features of the disclosed embodiments. That is, other types of printers can be implemented in accordance with different embodiments. For example, the printing system 310 can be configured as a printer that uses water-based inks or solvent-based inks, or in some cases may utilize toner ink in the context of a LaserJet printing embodiment.

In an embodiment, the sheet feed module 311 of the printing system 310 can be configured to hold, for example, 2,500 sheets of 90 gsm, 4.0 caliper stock in each of two trays. With 5,000 sheets per unit and up to 4 possible feeders in such a configuration, 20,000 sheets of non-stop production activity can be facilitated by the sheet feed module can include an upper tray 17 that holds, for example, paper sizes 8.27"×10"/210 m×254 mm to 14.33"×20.5"/364 m×521 mm, while a lower tray 19 can hold paper sizes ranging from, for example, 7"×10"/178 m×254 mm to 14.33"×20.5"/364 m×521 mm. Each feeder can utilize a shuttle vacuum feed head to pick a sheet of media off the top of the stack and deliver it to a transport mechanism.

In an embodiment, the print head and ink assembly module 312 of the printing system 310 can include a plurality of inkjet print heads that can be configured to deliver four different drop sizes through, for example, 7,870 nozzles per color to produce prints with, for example, a 600×600 dpi. An integrated full-width scanner can enable automated print head adjustments, missing jet correction and image-on-paper registration. Operators can make image quality improvements for special jobs such as edge enhancement, trapping, and black overprint. At all times automated checks and preventative measures can maintain the press in a ready state and operational.

The dryer module 313 of the printing system 310 can include a dryer. After printing, the sheets of media can move directly into a dryer where the paper and ink are heated with seven infrared carbon lamps to about 90° C. (194° F.). This process can remove moisture from the paper so that the sheets of media are sufficiently stiff to move efficiently through the paper path. The drying process can also remove moisture from the ink to prevent it from rubbing off. A combination of sensors, thermostats, thermistors, thermopiles, and blowers can accurately heat these fast-moving sheets of media, and can maintain a rated print speed.

The production stacker 314 can include a finisher that can run continuously as it delivers up to, for example, 2,850 sheets of media at a time. Once unloaded, the stack tray can return to the main stack cavity to pick and deliver another load—continuously. The stacker 114 can provide an adjustable waist-height for unloading from, for example, 8" to 24", and a by-pass path with the ability to rotate sheets to downstream devices. The production stacker 14 can also be configured with, for example, a 250-sheet top tray for sheet purge and samples, and can further include an optional production media cart to ease stack transport. One non-limiting example of printing system 310 is the Xerox® Brenva® HD Production Inkjet Press, a printing product of Xerox Corporation. The printing system can include transport members including the transport belts discussed herein and/or other features including for example a Brenva®/Fervent® marker transport, which is also a product of Xerox Corporation.

As can be appreciated by one skilled in the art, embodiments can be implemented in the context of a method, data processing system, or computer program product. Accordingly, embodiments may take the form of an entirely hardware embodiment, an entirely software embodiment or an embodiment combining software and hardware aspects all generally referred to herein as a "circuit" or "module." Furthermore, embodiments may in some cases take the form of a computer program product on a computer-usable storage medium having computer-usable program code embodied in the medium. Any suitable computer readable medium may be utilized including hard disks, USB Flash Drives, DVDs, CD-ROMs, optical storage devices, magnetic storage devices, server storage, databases, etc.

Computer program code for carrying out operations of the present invention may be written in an object oriented programming language (e.g., Java, C++, etc.). The computer program code, however, for carrying out operations of particular embodiments may also be written in procedural programming languages or in a visually oriented programming environment.

The program code may execute entirely on a user's computer, partly on a user's computer, as a stand-alone software package, partly on a user's computer and partly on a remote computer or entirely on the remote computer. In the latter scenario, the remote computer may be connected to a user's computer through a bidirectional data communications network (e.g., a local area network (LAN), wide area network (WAN), wireless data network, a cellular network, etc.) or the bidirectional connection may be made to an external computer via most third party supported networks (e.g., through the Internet utilizing an Internet Service Provider).

The embodiments are described at least in part herein with reference to flowchart illustrations and/or block diagrams of methods, systems, and computer program products and data structures according to embodiments of the invention. It will be understood that each block of the illustrations, and combinations of blocks, can be implemented by computer program instructions. These computer program instructions may be provided to a processor of, for example, a general-purpose computer, special-purpose computer, or other programmable data processing apparatus to produce a machine, such that the instructions, which execute via the processor of the computer or other programmable data processing apparatus, create means for implementing the functions/acts specified in the block or blocks. To be clear, the disclosed embodiments can be implemented in the context of, for example a special-purpose computer or a general-purpose computer, or other programmable data processing apparatus or system. For example, in some embodiments, a data processing apparatus or system can be implemented as a combination of a special-purpose computer and a general-purpose computer.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the various block or blocks, flowcharts, and other architecture illustrated and described herein.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 10:
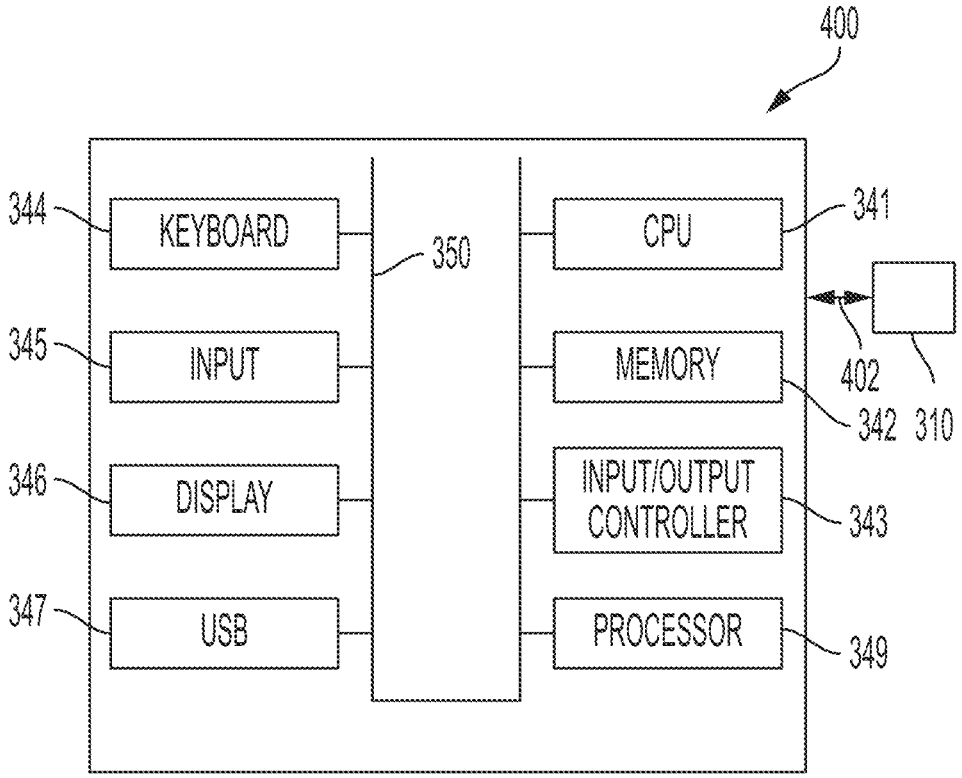
FIG. 10 illustrates a schematic view of a computer system, in accordance with an embodiment.
Figure 11:
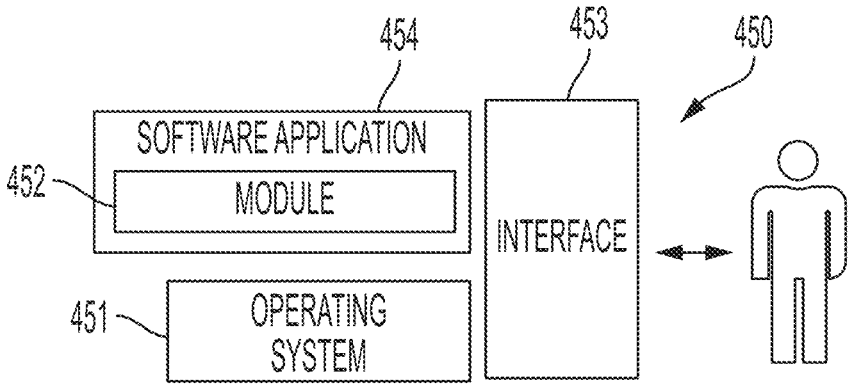
FIG. 11 illustrates a schematic view of a software system including a module, an operating system, and a user interface, in accordance with an embodiment.

FIGS. 10-11 are shown only as exemplary diagrams of data-processing environments in which example embodiments may be implemented. It should be appreciated that FIGS. 10-11 are only exemplary and are not intended to assert or imply any limitation with regard to the environments in which aspects or embodiments may be implemented. Many modifications to the depicted environments may be made without departing from the spirit and scope of the disclosed embodiments.

As illustrated in FIG. 11, some embodiments may be implemented in the context of a data-processing system 400 that can include, for example, one or more processors including a CPU (Central Processing Unit) 341 and/or other another processor 349 (e.g., microprocessor, microcontroller etc), a memory 342, an input/output controller 343, a peripheral USB (Universal Serial Bus) connection 347, a keyboard 344 and/or another input device 345 (e.g., a pointing device such as a mouse, trackball, pen device, etc.), a display 346 (e.g., a monitor, touch screen display, etc) and/or other peripheral connections and components. FIG. 16 is an example of a computing device that can be adapted for use in accordance with one possible embodiment.

As illustrated, the various components of data-processing system 400 can communicate electronically through a system bus 351 or similar architecture. The system bus 351 may be, for example, a subsystem that transfers data between, for example, computer components within data-processing system 400 or to and from other data-processing devices, components, computers, etc. The data-processing system 400 may be implemented in some embodiments as, for example, a server in a client-server based network (e.g., the Internet) or in the context of a client and a server (i.e., where aspects are practiced on the client and the server).

In some example embodiments, data-processing system 400 may be, for example, a standalone desktop computer, a laptop computer, a Smartphone, a pad computing device, a networked computer server, and so on, wherein each such device can be operably connected to and/or in communication with a client-server based network or other types of networks (e.g., cellular networks, Wi-Fi, etc). The data-processing system 400 can communicate with other devices or systems (e.g., the printing system 310). Communication between the data-processing system 400 and the printing system 310 can be bidirectional, as indicated by the double arrow 402. Such bidirectional communications may be facilitated by, for example, a computer network, including wireless bidirectional data communications networks.

FIG. 11 illustrates a computer software system 450 for directing the operation of the data-processing system 400 depicted in FIG. 10. Software application 454, stored for example in the memory 342 can generally include one or more modules, an example of which is module 452. The computer software system 450 also can include a kernel or operating system 451 and a shell or interface 453. One or more application programs, such as software application 454, may be "loaded" (i.e., transferred from, for example, mass storage or another memory location into the memory 342) for execution by the data-processing system 400. The data-processing system 400 can receive user commands and data through the interface 453; these inputs may then be acted upon by the data-processing system 400 in accordance with instructions from operating system 451 and/or software application 454. The interface 453 in some embodiments can serve to display results, whereupon a user (shown at the right side of FIG. 11) may supply additional inputs or can terminate a session. The software application 454 can include module(s) 452, which can, for example, implement instructions or operations such as those discussed herein. Module 452 may also be composed of a group of modules and/or sub-modules.

The following discussion is intended to provide a brief, general description of suitable computing environments in which the system and method may be implemented. Although not required, the disclosed embodiments will be described in the general context of computer-executable instructions, such as program modules, being executed by a single computer. In most instances, a "module" can constitute a software application, but can also be implemented as both software and hardware (i.e., a combination of software and hardware).

Generally, program modules include, but are not limited to, routines, subroutines, software applications, programs, objects, components, data structures, etc., that perform particular tasks or implement particular data types and instructions. Moreover, those skilled in the art will appreciate that the disclosed method and system may be practiced with other computer system configurations, such as, for example, hand-held devices, multi-processor systems, data networks, microprocessor-based or programmable consumer electronics, networked PCs, minicomputers, mainframe computers, servers, and the like.

Note that the term module as utilized herein may refer to a collection of routines and data structures that perform a particular task or implements a particular data type. A module may be composed of two parts: an interface, which lists the constants, data types, variable, and routines that can be accessed by other modules or routines, and an implementation, which may be private (e.g., accessible only to that module) and which can include source code that actually implements the routines in the module. The term module can also refer to an application, such as a computer program designed to assist in the performance of a specific task, such as word processing, accounting, inventory management, etc. A module may also refer to a physical hardware component or a combination of hardware and software. The previously discussed dryer module 313 is an example of a physical hardware component that can also operate according to instructions provided by a module such as module 452.

The module 452 may include instructions (e.g., steps or operations) for performing operations such as those discussed herein. For example, module 452 may include instructions for operating the marker transport system 130 in the context of a printing system such as the printing system 310.

The module 452 may include instructions for implementing a method of operating the marker transport system 130. Such instructions can include, for example, generating a vacuum with a vacuum source, wherein the vacuum source and a pneumatic solenoid block are associated with a marking transport platen, wherein a plurality of print bars is located with respect to the marker transport platen and a marker transport belt, wherein the marker transport platen is configured with airflow sections divided into process-direction slots and cross-section direction slots, wherein the cross-section direction slots are located beneath the plurality of print bars and are connected to the vacuum source via the pneumatic solenoid block, wherein the pneumatic solenoid block facilitates an individual control of each of the cross-process direction slots; and timing a plurality of pneumatic valves associated with the pneumatic solenoid block, which supplies a flow of the vacuum to the cross-process direction vacuum slots, to allow the vacuum to be present when a sheet of media is present over a corresponding vacuum slot among the process-direction slots and the cross-section direction slots.

FIG. 12 illustrates a block diagram depicting the printing system 310, which can include a vacuum roller system 100 that includes the aforementioned operator side vacuum baffle roller system sub-assembly 140, in accordance with an embodiment. The printing system 310 shown in FIG. 12 is an alternative version of the embodiment shown in FIG. 9, and can include, for example, the processor 349, the memory 342, and the controller 343, which together may operate specific components of a printing system such as the marker transport system 130. Alternatively, the printing system 310 may simply communicate with a data-processing system such as the data-processing system 400 to operate components of the printing system 310 such as the marker transport system 130.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A method of operating a marker transport system, comprising:

generating a vacuum with a vacuum source, wherein the vacuum source and a pneumatic solenoid block are associated with a marking transport platen, wherein a plurality of print bars are located with respect to the marker transport platen and a marker transport belt, wherein the marker transport platen is configured with airflow sections divided into process-direction slots and cross-section direction slots, wherein the cross-section direction slots are located beneath the plurality of print bars and are connected to the vacuum source via the pneumatic solenoid block, wherein the pneumatic solenoid block facilitates an individual control of each of the cross-process direction slots; and timing a plurality of pneumatic valves associated with the pneumatic solenoid block, which supplies a flow of the vacuum to the cross-process direction vacuum slots, to allow the vacuum to be present when a sheet of media is present over a corresponding vacuum slot among the process-direction slots and the cross-section direction slots.

2. The method of claim 1 further determining with at least one sensor, a leading edge and a trailing edge of a sheet relative to a position on the marker transport belt.

3. The method of claim 2 wherein the at least one sensor comprises a belt-hole sensor.

4. The method of claim 1 wherein the process-direction slots are associated with a plurality of process-section channels configured from the marker transport platen and wherein the cross-process direction vacuum slots are associated with a plurality of process-section channels configured from the marker-transport platen.

5. The method of claim 1 wherein a printing system includes the marker transport system.

6. A system, comprising:

at least one processor; and a non-transitory computer-usable medium embodying computer program code, said computer-usable medium capable of communicating with said at least one processor, said computer program code comprising instructions executable by said at least one processor and configured for:

generating a vacuum with a vacuum source, wherein the vacuum source and a pneumatic solenoid block are associated with a marking transport platen, wherein a plurality of print bars are located with respect to the marker transport platen and a marker transport belt, wherein the marker transport platen is configured with airflow sections divided into process-direction slots and cross-section direction slots, wherein the cross-section direction slots are located beneath the plurality of print bars and are connected to the vacuum source via the pneumatic solenoid block, wherein the pneumatic solenoid block facilitates an individual control of each of the cross-process direction slots; and timing a plurality of pneumatic valves associated with the pneumatic solenoid block, which supplies a flow of the vacuum to the cross-process direction vacuum slots, to allow the vacuum to be present when a sheet of media is present over a corresponding vacuum slot among the process-direction slots and the cross-section direction slots.

7. The system of claim 6 wherein the instructions are further configured for determining with at least one sensor, a leading edge and a trailing edge of a sheet relative to a position on the marker transport belt.

8. The system of claim 7 wherein the at least one sensor comprises a belt-hole sensor.

9. The system of claim 6 wherein the process-direction slots are associated with a plurality of process-section channels configured from the marker transport platen and wherein the cross-process direction vacuum slots are associated with a plurality of process-section channels configured from the marker-transport platen.

* * * * *